US007047992B1

(12) United States Patent
Fluellen

(10) Patent No.: US 7,047,992 B1
(45) Date of Patent: May 23, 2006

(54) LAWN CHAIR SCREEN AND COVER

(76) Inventor: Rudy Fluellen, 205 Boston St., Jesup, GA (US) 31545

( * ) Notice: Subject to any disclaimer, the term of this patent is extended or adjusted under 35 U.S.C. 154(b) by 0 days.

(21) Appl. No.: 10/251,389

(22) Filed: Sep. 20, 2002

(51) Int. Cl.
*E04H 15/28* (2006.01)
*E04H 15/02* (2006.01)

(52) U.S. Cl. ..... 135/98; 135/136; 135/901; 297/184.16; 43/1

(58) Field of Classification Search ..... 135/98–99, 135/16, 901–902, 115–117, 124, 136–137, 135/913; 297/188.2, 184.13, 184.1, 184.15–184.16, 297/184.2; 43/1; 248/512, 513; 24/386–389
See application file for complete search history.

(56) References Cited

U.S. PATENT DOCUMENTS 144,792 A * 11/1873 Prentiss ..... 135/98
1,531,622 A * 3/1925 Parsons ..... 135/93
1,711,843 A * 5/1929 Hammond ..... 47/23.2
2,221,366 A * 11/1940 Bisbing et al. ..... 135/16
2,385,816 A * 10/1945 Krupp ..... 24/387
2,864,389 A * 12/1958 Smith et al. ..... 135/98
2,935,074 A * 5/1960 Baker ..... 135/98
2,943,634 A * 7/1960 Morgan ..... 135/96
3,136,356 A * 6/1964 Mears ..... 160/87
3,333,595 A * 8/1967 Bannister et al. ..... 135/98
3,799,608 A * 3/1974 Smutny et al. ..... 297/184.14
4,327,520 A * 5/1982 Saxby et al. ..... 47/29.1
4,364,193 A * 12/1982 Visco ..... 43/1
4,782,616 A * 11/1988 Hambleton ..... 43/1
4,825,578 A * 5/1989 Robinson ..... 43/1
5,269,157 A * 12/1993 Ciminelli et al. ..... 297/193
5,396,916 A * 3/1995 Boissonnault ..... 135/16
5,518,218 A * 5/1996 Leonard ..... 248/530
5,678,587 A * 10/1997 Bilotti ..... 135/98
6,167,898 B1 * 1/2001 Larga et al. ..... 135/137
6,397,869 B1 * 6/2002 Jennings ..... 135/93
6,554,012 B1 * 4/2003 Patarra ..... 135/16
6,634,609 B1 * 10/2003 Zheng ..... 248/277.1
6,637,447 B1 * 10/2003 McMullin et al. ..... 135/16

* cited by examiner

*Primary Examiner*—Winnie Yip
(74) *Attorney, Agent, or Firm*—John D. Gugliotta; Olen L. York, III

(57) ABSTRACT

The lawn chair screen and cover is an enclosure system for lawn or folding chairs to protect the occupant from flying insects. The lawn chair screen and cover is made of fabric mesh and supported by a frame structure that may connect to the chair by rope, hook and loop fasteners or clamps. The fabric mesh extends around the chair, thus allowing the user full visibility and air flow through the lawn chair screen and cover. The sloped front of the invention provides a door closed by a zipper. An opening is ideal for allowing a fishing rod to extend through, thus allowing the user to comfortably fish while being shielded from flying insects such as mosquitoes, flies, gnats and the like. The use of the lawn chair screen and cover allows outdoor enthusiasts the ability to sit and relax in a chair without being annoyed or bitten by flying insects.

17 Claims, 6 Drawing Sheets

LAWN CHAIR SCREEN AND COVER

RELATED APPLICATIONS

The present invention was first described in Disclosure Document Registration 502,395 filed on Dec. 17, 2001 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to an insect screen, more particularly, an insect screen attached to a lawn chair and provided with an opening for the passage of various items.

2. Description of the Related Art

A great number of people around the world enjoy fishing. Whether fishing for food or for the sport of it, the calmness and serenity of the sport coupled with the excitement of landing "the big one" makes fishing a popular pastime. Much fishing takes place from a chair on the banks of a river or lake. While this type of fishing has many advantages, one disadvantage that must be dealt with is that of flying insects such as mosquitoes, flies, gnats and the like. Area foggers, bug lights, candles and the like provide some relief, but they are not totally effective and may negatively affect the environment. Also, if one should move their chair, the repellent system is difficult or impossible to move. Another solution is that of a spray-on insect repellant. However, many people do not like the feel or smell of such sprays. These sprays also require repeated application, especially if the user is sweating or gets wet.

The present invention is aimed at a screen and cover attachable to a lawn chair, thereby preventing annoyance from insects while fishing or other outdoor activities. The present invention is a dome-shaped screen coupled to a support member. The support member may include a connector, such as rope or a hook and loop material strap, for securing the support member to a lawn chair. The present invention includes an entrance and an opening for passing items into and out of the screen and cover. The present invention may be reinforced with a sufficiently rigid band that maintains the structure of the screen.

A search of the prior art did not disclose any patents that read directly on the claims of the instant invention; however, the following references were considered related.

U.S. Pat. No. 5,797,650 issued in the name of Gonzalez, Jr. et al., describes a sunshade attachment for a chair.

U.S. Pat. No. 5,320,405 issued in the name of Foster et al., describes a sunshade attachment for a chair.

U.S. Pat. No. 5,203,363 issued in the name of Kidwell et al., describes a portable canopy attachment.

U.S. Pat. No. 5,135,281 issued in the name of Pappalardo, describes a sunshade attachment for a chair.

U.S. Pat. No. 5,096,257 issued in the name of Clark, describes an adjustable sunshade apparatus for a recreational chair.

U.S. Pat. No. 4,643,479 issued in the name of Servi, describes a wheelchair shade or canopy means.

U.S. Pat. No. 3,404,915 issued in the name of de Souza Filho, describes a combination beach chair and cot.

U.S. Pat. No. 900,572 issued in the name of Morton, describes a sunshade attachment for a chair.

Consequently, there exists a continuous need for new product ideas and enhancements for existing products in the insect screen industry.

SUMMARY OF THE INVENTION

It is therefore an object of the present invention to provide a screen and cover attachable to a lawn chair.

It is a feature of the present invention to provide a lawn chair screen and cover that combines inexpensive and long-lasting components completely integrated to provide a convenient means for enjoying outdoor activities without the annoyance or interference of insects.

It is yet another feature of the present invention to provide a lawn chair screen and cover that includes an entrance for entering and exiting the device.

It is yet another feature of the present invention to provide a lawn chair screen and cover that includes an opening for allowing penetration by a fishing rod, a hunting rifle or other items that might be passed from inside to outside or vice versa.

It is yet another feature of the present invention to provide a lawn chair screen and cover that includes a support member that may be collapsed thereby providing a convenient means for storage or transportation.

It is yet another feature of the present invention to provide a lawn chair screen and cover that includes reinforcing bands for maintaining the structural integrity of the screen.

It is yet another feature of the present invention to provide a lawn chair screen and cover that includes a second opening capable of accommodating a second fisher or hunter.

It is yet another feature of the present invention to provide a lawn chair screen and cover that includes a padded compartment for allowing a user to rest.

It is yet another feature of the present invention to provide a lawn chair screen and cover that includes an outside canopy, thereby allowing other users to shade themselves.

It is yet another feature of the present invention to provide a lawn chair screen and cover that includes a cooling and/or heating system.

Briefly described according to one embodiment of the present invention, the lawn chair screen and cover, provides an enclosure system for lawn or folding chairs to protect the occupant from flying insects. Designed specifically for use with lawn or folding chairs, the invention is made of fabric mesh and supported by a frame structure that connects to the chair by rope, hook and loop fasteners or clamps. The fabric mesh extends all around the chair, thus allowing the user full visibility and air flow through the invention. The sloped front of the invention provides a door closed by a zipper. An opening is also ideal for allowing a fishing rod to extend through, thus allowing the user to comfortably fish while being shielded from flying insects such as mosquitoes, flies, gnats and the like. The use of the lawn chair screen and cover allows outdoor enthusiasts the ability to sit and relax in a chair without being annoyed or bitten by flying insects.

An advantage of the present invention is that it is specifically adapted for personal use because of the light weight components and the use of inexpensive materials, making the present invention cost affordable and easy to assemble and disassemble.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 3-B is an exploded perspective of an alternative embodiment of the impingement means, depicting the upper portion and middle portion connected by threaded members;

FIG. 4-B is a perspective view of a connector depicted button snaps;

FIG. 4-C is a perspective view of a connector depicted rope or string;

FIG. 4-D is a perspective view of a connector depicted as a C-shaped connector with ribs that is snapped onto and around the frame of a lawn chair;

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
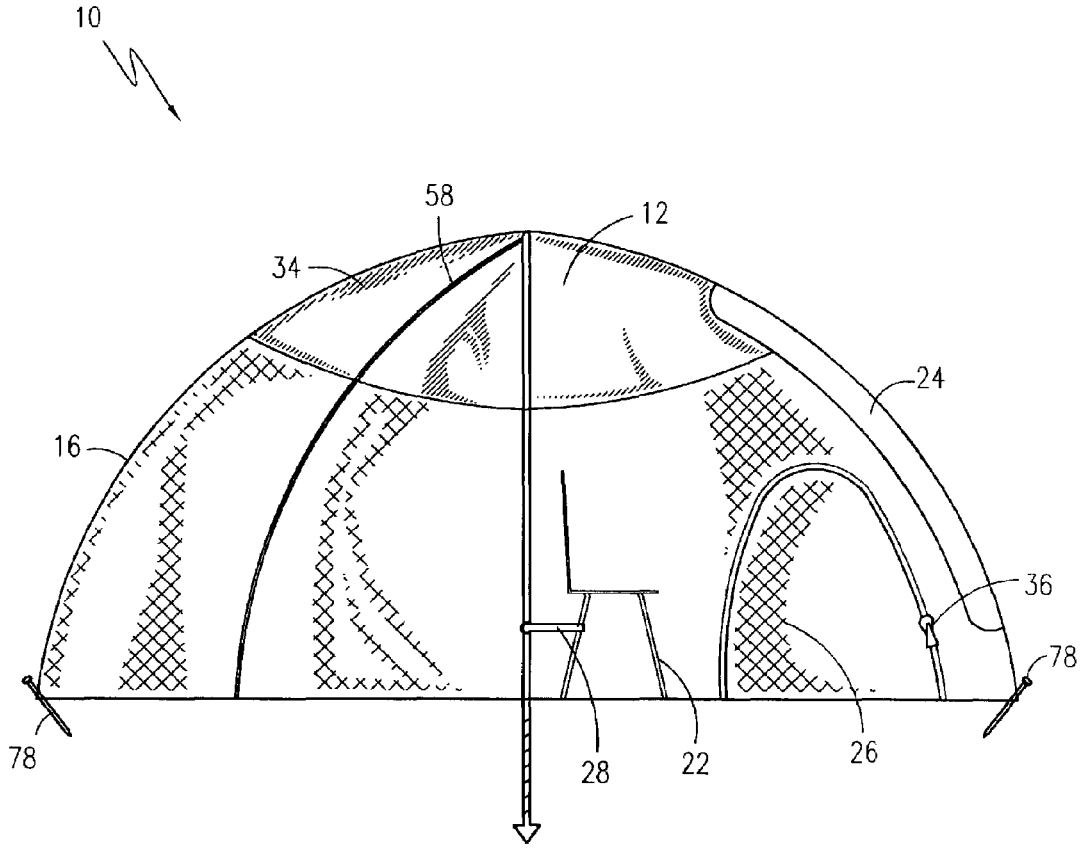
FIG. 1 is a side view of a lawn chair screen and cover.

Referring now to FIG. 1, a lawn chair screen and cover 10 is shown, according to the present invention, and includes a linearly elongated vertical support member 12, wherein the support member 12 includes an upper portion 14 supporting the apex of a mesh-lattice screen 16, a middle portion 18, and a lower portion 20 coupled to a lawn chair 22 by a connector 28. The lawn chair screen and cover 10 further includes an entrance 26, for entering and exiting the lawn chair screen and cover 10, and an opening 24 so as to allow passage of various items through the lawn chair screen and cover 10, such as fishing rods, hunting weapons, food or other similar items. The lawn chair screen and cover 10 is a dome-shaped device.

Figure 2:
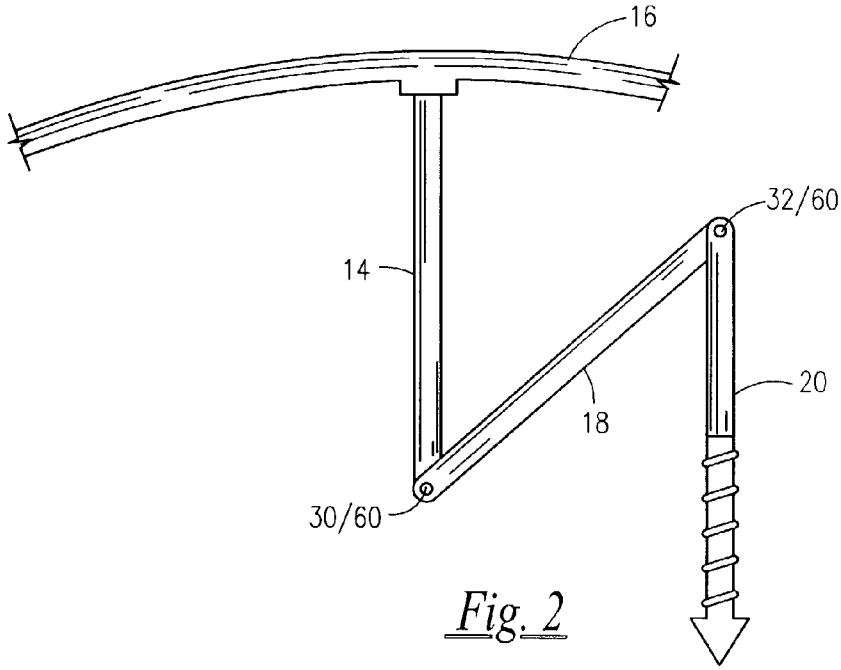
FIG. 2 is a side view of a support member, having lockable and collapsible hinges, and depicting the upper, middle and lower portions in a collapsed manner.
Figure 3A:
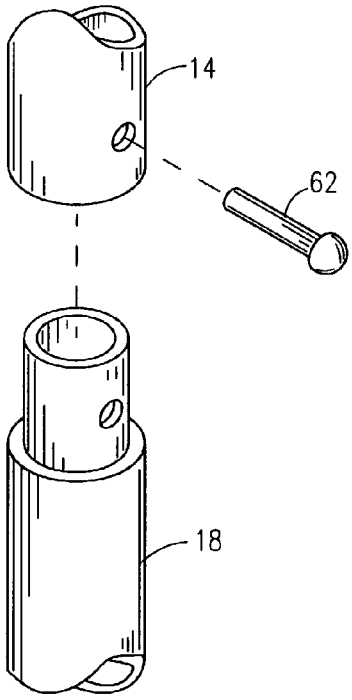
FIG. 3-A is an exploded perspective view of the upper portion and the middle portion connected by an impingement pin placed through an aperture in the upper and middle portions of the support member.
Figure 3B:
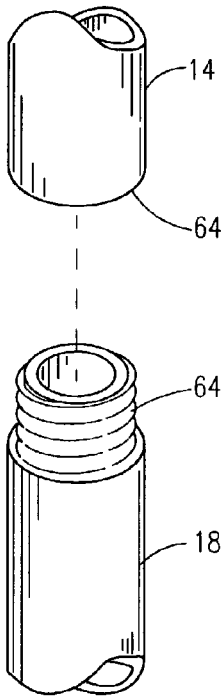
Figure 4A:
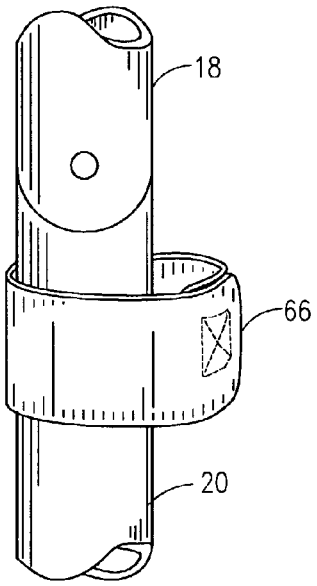
FIG. 4-A is a perspective view of a connector depicted as hook and loop material.
Figure 4B:
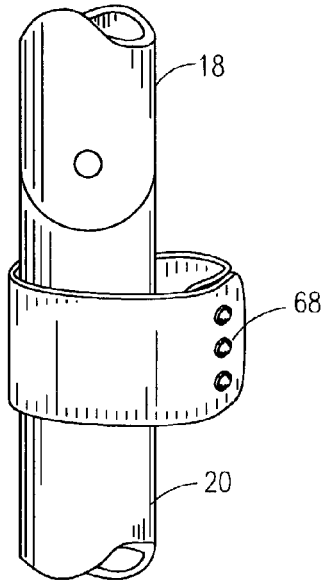
Figure 4C:
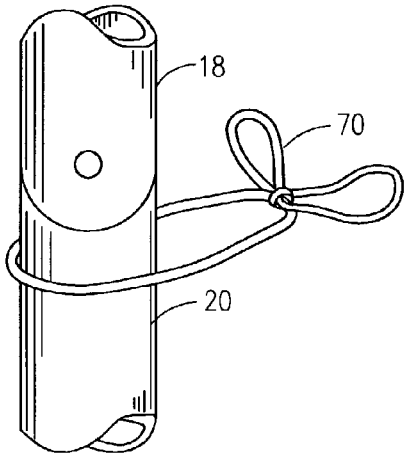
Figure 4D:
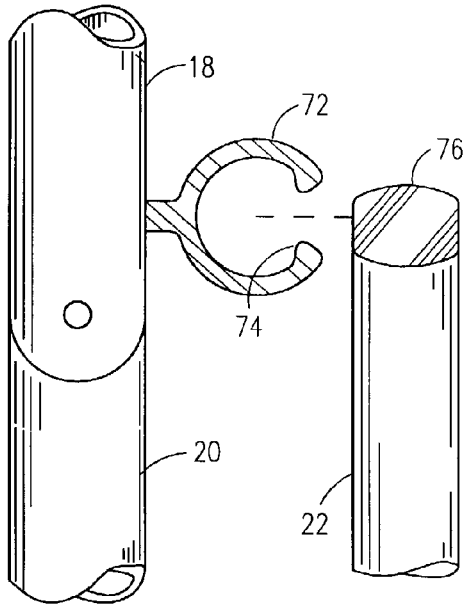

Referring now to FIG. 1 and FIG. 2, the support member 12 includes an upper portion 14 coupled to a middle portion 16 by a first impingement means 30, and the middle portion 18 coupled to a lower portion 20 by a second impingement means 32. The first and second impingement means 30 and 32 allow the support member 12 to foldably collapse into a compacted component, thereby providing easy disassembly, storage and transportation. Preferably, the upper portion 14 and middle portion 18 are each approximately three to four feet in length, while the lower portion 20 is no shorter than three and one-half feet in length. The length combinations described provide a unitary support member 12 which may vary from nine and one-half feet to eleven and one-half in height. At least one and one-half feet of the lower portion 20 is buried within the ground, either driven like a stake or cork-screwed into the ground, thereby providing a lawn chair screen and cover 10 that has an apex height of at least eight feet and may extend as tall as ten feet. The lower portion 20 includes a connector 28 for securing the support member 12 to the lawn chair 22. The connector 28 may be a hook and loop material strap 66, a button snap strap 68, a rope 70, or a C-shaped connector 72 (as shown in FIG. 4-A through FIG. 4-D). The C-shaped connector 72 with a pair of opposable gripping ribs 74 for sliding around and coupling to the upper back 76 of a lawn chair 22. The first and second impingement means 30 and 32 may be locking and collapsible hinges 60 (FIG. 2), pins 62 (FIG. 3-A), or threaded members 64 (FIG. 3-B) coupled to one another. Preferably, the support member 12 is manufactured from a flexibly-durable, lightweight material, such as plastic, so as to provide structural support for the screen 16 while providing easy of assembly, disassembly, transportation and storage.

Figure 5:
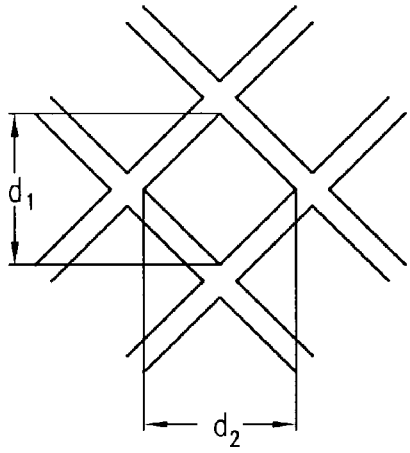
FIG. 5 is a top view of the mesh-lattice screen depicting the diameters of the lattice $d_1$ and $d_2$ in which the lattice diameters are preferably less than 0.50 millimeters.

Referring now to FIG. 5, the mesh-lattice screen 16 is a tightly woven mesh-lattice pattern with a diameter "$d_1$" or "$d_2$" that is 0.50 millimeters or less, thereby preventing the usual size of insects from penetrating the lawn chair screen and cover 10. However, the mesh-lattice pattern allows for the fresh circulation of air through the lawn chair screen and cover 10. Preferably, the mesh-lattice screen 16 is manufactured from nylon or other similar material capable of withstanding repeated assembly and disassembly and general use associated with such an item.

Referring again to FIG. 1, a protective hoop 34 lies along the curvilinear plane of the mesh-lattice screen 16 and radially extending from the apex of the screen 16. The protective hoop 34 is attached to the screen 16 by hook and loop material, button snaps, tie downs or another securing mechanism and may be attached to or removed from the screen 16 depending upon the environment desired by the user. For instance, the protective hoop 34 might be attached to the screen 16 so as to provide protection from rain or snow. Conversely, the protective hoop 34 might be removed from the screen 16 so as to provide a sunbather protection from the insects while allowing sunlight to penetrate the screen 16. The protective hoop 34 might include reflective material so as to combat the ultraviolet and heat generating rays emitted by the sun.

The entrance 26 is positioned along the circumference of, and in the same curvilinear plane as the screen 16, providing a convenient means for entering and exiting the lawn chair screen and cover 10. The entrance 26 extends from the lower lip of the screen 16 and up to a point approximately four feet high along the circumference of the screen 16, although a variation of the height is foreseeable. The entrance 26 avoids the inefficient necessity of entering and exiting the lawn chair screen and cover 10 by way of raising the lowest lip of the screen 16, and then hoping that the lawn chair screen and cover 10 remains secured and/or standing. Preferably, the entrance 26 is opened or closed by a zipper 36, although it is foreseeable that other closure means 36 may be employed, such as button snaps or hook and loop fasteners.

A plurality of support bands 58 are included which radiate from the apex of the screen 16 and extending to the lowest lip of the screen 16. The bands 58 act to provide further structural reinforcement to the lawn chair screen and cover 10.

Figure 6:
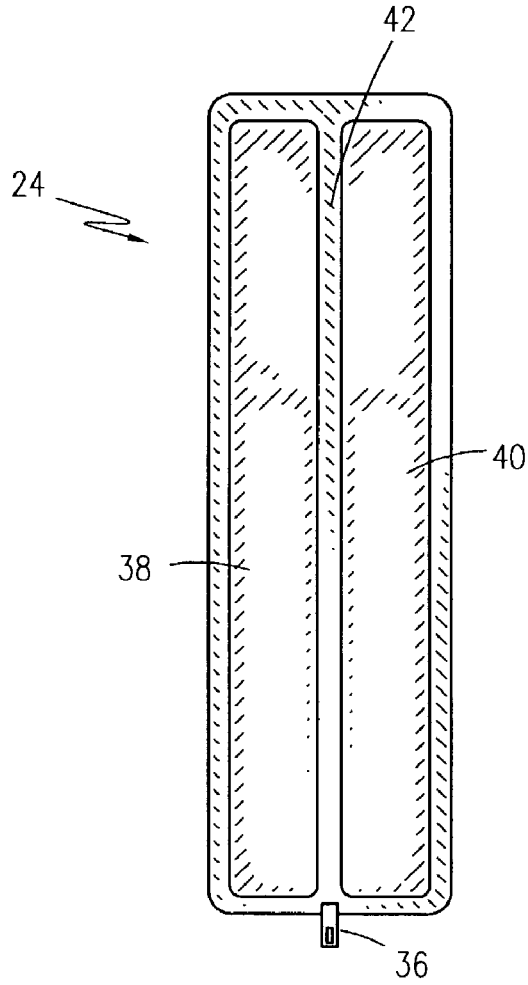
FIG. 6 is a front view of the opening in the screen illustrating the two rectangular panels filled with foam and the integral relationship between the panels forming the slit for passing items from the outside to the inside.

Referring to FIG. 1 and FIG. 6, the opening 24 is positioned along the circumference of, and in the same curvilinear plane as the lawn chair screen and cover 10, thereby providing a convenient means for passing items through the lawn chair screen and cover 10 without having to physically pass the items through the entrance 22. The opening 24 extends from near the apex of the dome to near the lip of the screen 16, and is approximately six feet in length and approximately six to twelve inches wide. The opening 24 has two rectangular panels 38 and 40, in which the first and second panels 38 and 40 extend along the curvilinear length of the opening 24. The first and second panels 38 and 40 are filled with a soft material, such as foam, to provide structural support to the first and second panels 38 and 40 while also providing the flexibility desired for passing items into and out of the lawn chair screen and cover 10. The first and second panels 38 and 40 are integral along respective lengths so as to provide a resilient slit 42 in which the slit 42 completely seals around and envelopes an item passed through or when unused. Thus, the opening 24 allows a fisher to cast a rod either within or outside the lawn chair screen and cover 10, pass the handle of the rod/reel through the opening 24 and patiently wait for a strike. When the line is struck, the opening 24 allows a fisher to pull on the rod/reel either up or down the length of the opening 24, and ultimately, pull the fish into the lawn chair screen and cover 10. Preferably, the opening 24 is positioned at least eighteen inches up and away from the lowest lip of the screen 16 so as to ensure optimum convenience for passing a fishing rod or other similar item through the lawn chair screen and cover 10. However, it is also foreseeable that people other than fishers may find use for the lawn chair screen and cover 10, such as hunters, and may pass a hunting rifle or any number of items from person to person without having to do so through the entrance 26 or underneath the lowest lip of the screen 16. Preferably, the opening 24 is opened or closed by a zipper 36, although it is foreseeable that other closure means may be employed, such as button snaps or hook and loop material.

Figure 7:
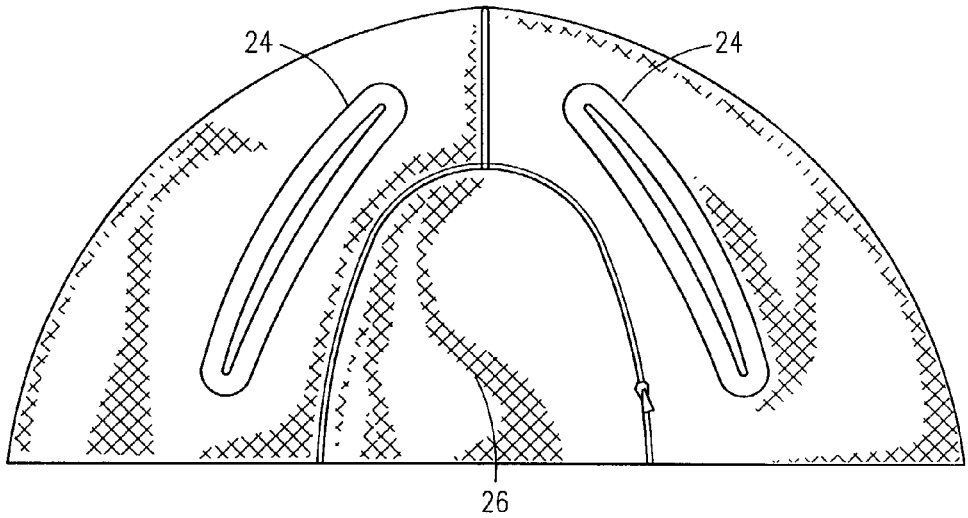
FIG. 7 is a side view of the lawn chair screen and cover depicting an alternative embodiment illustrating two openings and an entrance positioned between the two openings.
Figure 8:
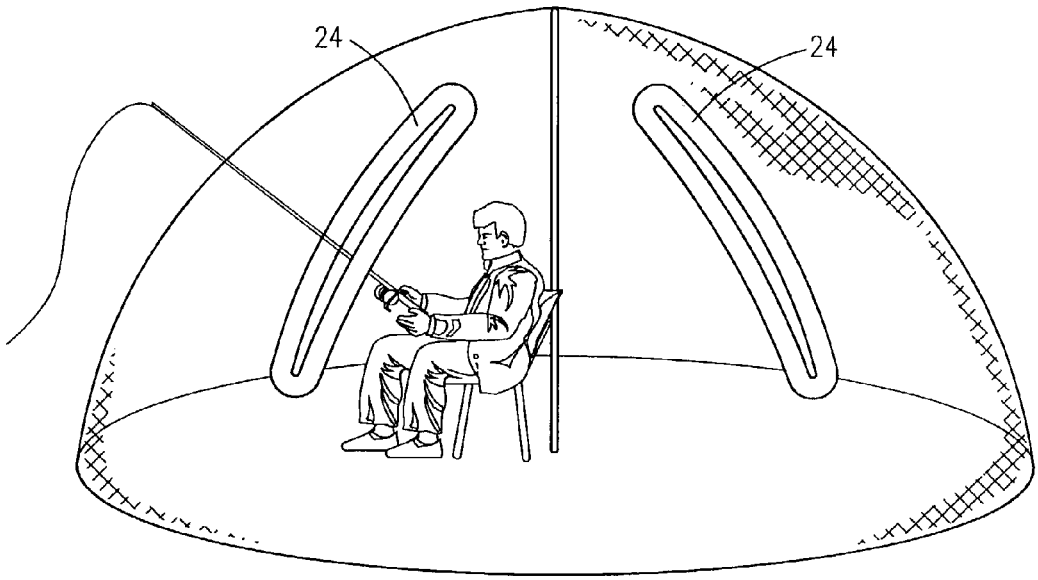
FIG. 8 is a perspective view of the alternative embodiment depicted in FIG. 7, illustrating a fisher using a rod and reel through the opening to fish.

Referring now to FIG. 7 and FIG. 8, an alternative embodiment is shown in which two openings 24 are included with the lawn chair screen and cover 10 so as to provide adaptability for accommodating two fishers or hunters. The two openings 24 have the same construction and arrangement as described for the lawn chair screen and cover 10 having one opening 24.

Figure 9:
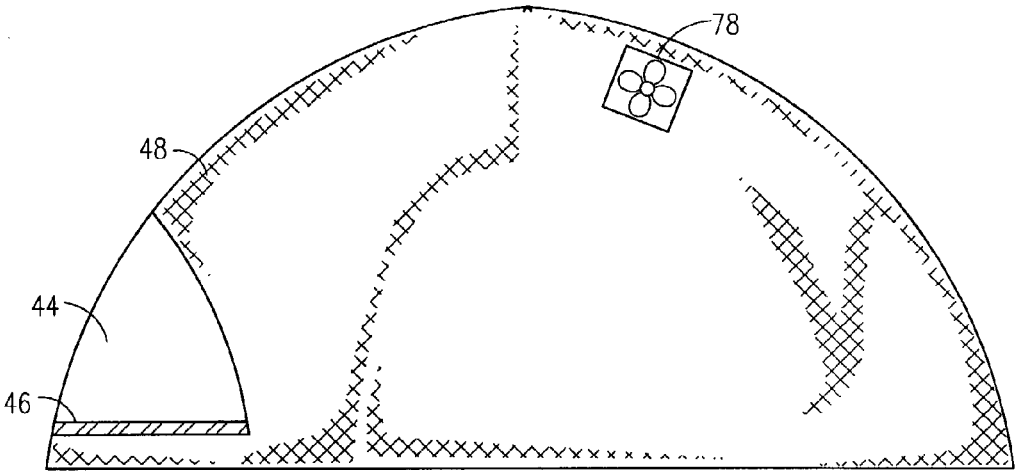
FIG. 9 is a side view of an alternative embodiment of FIG. 1 in which a padded compartment with enclosure and a cooling and/or heating system are included to provide added comfort to a user.

Referring now to FIG. 9, another alternative embodiment is shown in which the lawn chair screen and cover 10 includes a compartment 44 for providing a place for a user to lie down or rest. The compartment 44 includes a padded base 46 and an enclosure 48.

FIG. 9 also shows yet another alternative embodiment of the lawn chair screen and cover 10 which includes a cooling and/or heating system 78. The cooling and/or heating system 78 may include a fan or a water misting device for cooling and generated heat distributed by a fan. The fan, as shown in FIG. 9, preferably lies in the same curvilinear plane as the mesh-lattice screen 16 and is operated through electricity generated from an automobile or a generator. The cooling and/or heating system 78 adds further comfort and convenience to the user of the lawn chair screen and cover 10.

Figure 10:
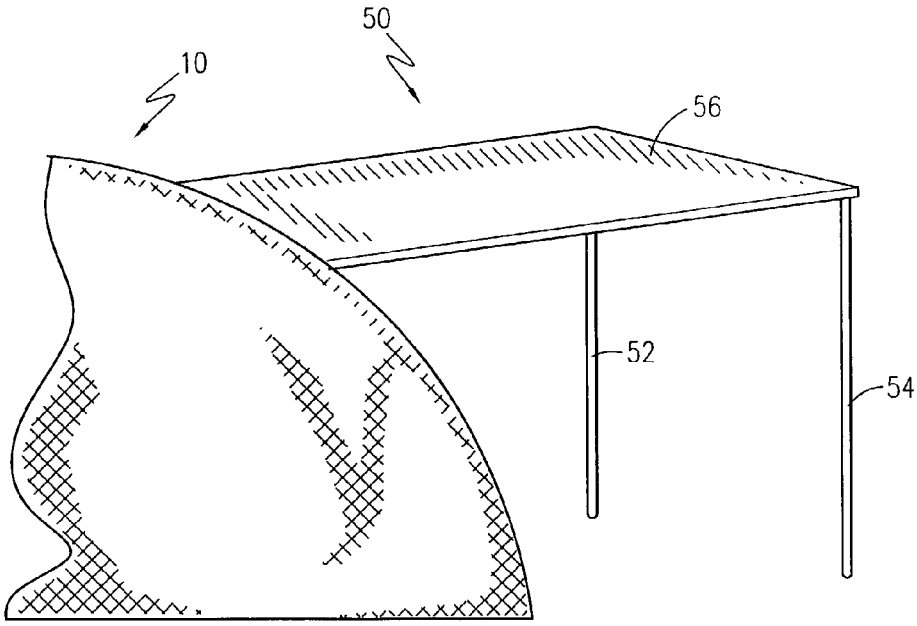
FIG. 10 is a perspective view of another alternative embodiment of FIG. 1 in which an outside canopy is included, having a cover and two legs, for providing shade to those that may not want to stay inside the lawn chair screen and cover.

Referring now to FIG. 10, another alternative embodiment is shown in which the lawn chair screen and cover 10 includes an adjustable canopy 50 which attaches along the outside of the screen 16. The canopy 50 includes two exterior support members (first exterior support member) 52 and (second exterior support member) 54 and a protective cover 56. The canopy 50 is envisioned as adaptable in allowing those that wish to remain outside the lawn chair screen and cover 10 to do so in a shaded area. The canopy 50 is adaptable to shade from one to four people comfortably.

2. Operation of the Preferred Embodiment

A user will unfold or the support member 12 about the impingement means 30 and 32, resulting in a unitary support member 12 at least nine and one-half feet in length. A user will then drive the pointed end of the lower portion 20 into the ground, either by force or by cork-screwing the lower portion 20 into the ground. The user will then place a plurality of stakes 78 around the lower lip of the screen 16 to secure the screen 16 to the ground. A user will then attach the lower portion 20 or middle portion 18 to the lawn chair 22 via a connector 28. A user may then pass a fishing rod (or hunting rifle) through the opening 24 and begin fishing (or hunting). While fishing, if a struggle ensues between the fisher and the fish, the fisher may raise or lower the rod within the opening 24.

To disassemble the lawn chair screen and cover 10, the user will pull up the stakes 78 and collapse (or disconnect) the support member 12. The user may then compact the lawn chair screen and cover 10 so as to fit within a traveling bag, case or within a compacted area of an automobile.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A lawn chair screen and cover system comprising:

linearly elongated support member having an upper portion, a middle portion and a lower portion;

a mesh-lattice screen coupled to and supported by said upper portion;

a removable protective cover extending radially from an apex of said mesh-lattice screen so as to provide protection against environmental elements;

a connector depending from said lower portion, and connects said support member to a lawn chair;

an entrance formed within said screen and located along the curvilinear circumference of said screen for allowing ingress into and egress out of said lawn chair screen and cover system; and an opening formed along the curvilinear circumference of said screen for allowing ingress and egress of items through said lawn chair screen and cover system, opening substantially transverses a length from an apex of said mesh-lattice screen to a lip of said mesh-lattice screen, and wherein said opening includes a fist rectangular panel and a second rectangular panel integrally coupled along a slit, said first and second panels filled with a soft material for providing rigid support and flexibility as said items are passed through said opening.

2. The lawn chair screen and cover system of claim 1, further comprising a plurality of support bands extending radially from an apex of said mesh-lattice screen and extending to a lip of said mesh-lattice screen so as to provide structural reinforcement to said mesh-lattice screen.

3. The lawn chair screen and cover system of claim 1, further comprising a cooling and heating system, said cooling and heating system including a fan for distributing cooled or warmed air.

4. The lawn chair screen and cover system of claim 1, further comprising an adjustable canopy attached to an outside portion of said screen and cover system, said canopy includes two exterior support members and a protective cover.

5. The lawn chair screen and cover system of claim 1, wherein said upper portion is coupled to a middle portion by first impingement means, said lower portion is coupled to said middle portion by a second impingement means.

6. The lawn chair screen and cover system of claim 5, wherein said first impingement means and said second impingement means are lockable and collapsible hinges.

7. The lawn chair screen and cover system of claim 5, wherein said first impingement means and said second impingement means are pins.

8. The lawn chair seen and cover system of claim 5, wherein said first impingement means and said second impingement means are treaded members coupled to one another.

9. The lawn chair screen and cover system of claim 1, wherein said mesh-lattice screen comprises a tightly woven mesh-lattice pattern having a small diameter for preventing insects from penetrating said lawn chair screen and cover system.

10. The lawn chair screen and cover system of claim 9, wherein said mesh-lattice screen is manufactured from nylon.

11. The lawn chair screen and cover system of claim 1, wherein said connector is hook and loop material.

12. The lawn chair screen and cover system of claim 1, wherein said connector is a button-snap strap.

13. The lawn chair screen and cover system of claim 1, wherein said connector is a rope.

14. The lawn chair screen and cover system of claim 1, wherein said connector is C-shaped comprising a pair of opposable gripping ribs for coupling to an upper back of said lawn chair.

15. The lawn chair screen and cover system of claim 1, wherein said entrance extends from a lower lip of said mesh-lattice screen upward to a point approximately four feet high, said entrance is opened and closed by a closure means.

16. The lawn chair screen and cover system of claim 1, further comprising a compartment, said compartment comprising a padded base and an enclosure for allowing a user to lie down.

17. A lawn chair screen and cover system comprising:

a linearly elongated support member having an upper portion, a middle portion and a lower portion;

a mesh-lattice screen coupled to and supported by said upper portion;

a removable protective cover extending radially from an apex of said mesh-lattice screen so as to provide protection against environmental elements;

a connector depending from said lower portion, and connects said support member to a lawn chair;

an entrance formed within said screen and located along the curvilinear circumference of said screen for allowing ingress into and egress out of said lawn chair screen and cover system; and an opening formed along the curvinear circumference of said screen for allowing ingress and egress of items through said lawn chair screen and cover system;

a compartment comprising a padded base and an enclosure for allowing a user to lie down.

* * * * *